US005427639A

United States Patent [19]

Minarelli

[11] Patent Number: 5,427,639

[45] Date of Patent: Jun. 27, 1995

[54] METHOD AND DEVICE FOR SPLICING NARROW STRIPS

[75] Inventor: Alessandro Minarelli, Bologna, Italy

[73] Assignee: G.D. Societa' Per Azioni, Bologna, Italy

[21] Appl. No.: 248,379

[22] Filed: May 24, 1994

[30] Foreign Application Priority Data

Jun. 1, 1993 [IT] Italy ..... BO93A0256

[51] Int. Cl.[6] ..... B31F 5/06

[52] U.S. Cl. ..... 156/157; 156/159; 156/504; 156/505; 242/552; 242/556.1

[58] Field of Search ..... 156/157, 159, 504, 505, 156/506; 242/552, 554.2, 556, 556.1

[56] References Cited

U.S. PATENT DOCUMENTS 2,930,427 3/1960 Fillmann et al. ..... 156/504
2,987,108 6/1961 Kilmartin ..... 156/504
3,136,678 6/1964 Herzig ..... 156/506 X
3,318,754 5/1967 Philippi ..... 156/505
3,351,514 11/1967 Creigh ..... 156/505 X
3,475,263 10/1969 Kapilow et al. ..... 156/505 X
3,654,034 4/1972 Hermle et al. ..... 156/505 X

FOREIGN PATENT DOCUMENTS 618865 3/1949 United Kingdom .

*Primary Examiner*—Mark A. Osele
*Attorney, Agent, or Firm*—Ladas & Parry

[57] ABSTRACT

A method and device for splicing narrow strips, whereby two portions of the two strips are superimposed and spliced by means of a pair of adhesive elements placed on either side of the superimposed strip portions, and each presenting a first portion connected to a respective strip, and at least one second portion connected to the other adhesive element.

5 Claims, 4 Drawing Sheets

METHOD AND DEVICE FOR SPLICING NARROW STRIPS

BACKGROUND OF THE INVENTION

The present invention relates to a method of splicing narrow strips.

Here and hereinafter, the term "narrow strip" is intended to mean a strip of film material of one or a few millimeters in width.

The present invention may be used to advantage, though in no way exclusively, on machines employing narrow strips fed off a reel, for splicing two strips and switching automatically or semiautomatically from a runout reel to a new reel.

In the following description, specific reference is made, purely by way of example, to the above application.

On machines employing reels of normal strip material, changeover from the runout reel to a new reel is normally effected automatically by means of a reel change device which provides for fly-splicing the trailing end of the strip on the runout reel to the leading end of the strip on the new reel. The two strips are normally spliced using an adhesive connecting element which is applied to the two adjacent aligned surfaces of the runout strip and new strip respectively.

Though valid for applications involving relatively wide strips, the above method is unreliable for splicing narrow strips such as the "tear-off" strips of packets in general, and packets of cigarettes in particular, in which case the splices made as described above are invariably weak and tend to fail even under the pull exerted on the strips as they are reeled off.

SUMMARY OF THE INVENTION

It is an object of the present invention to provide a method of splicing narrow strips, designed to overcome the aforementioned drawback.

According to the present invention, there is provided a method of splicing two narrow strips, the method comprising stages consisting in superimposing two portions of the two strips; and splicing the two superimposed strip portions; characterized in that the two superimposed strip portions are spliced by means of a pair of adhesive elements placed on either side of the superimposed strip portions, and each presenting a first portion which is connected to a respective said strip portion, and at least one second portion projecting from the respective said strip portion and which is connected to the other adhesive element.

In the above method, said first portion is preferably an intermediate portion of the adhesive element; said second portion comprising two lateral portions extending on either side of the respective intermediate portion, and each connected directly to a corresponding lateral portion of the other adhesive element.

The present invention also relates to a device for splicing narrow strips.

According to the present invention, there is provided a device for splicing two narrow strips, the device comprising guide means for positioning a first portion of a first strip and a second portion of a second strip with a first surface of the first strip portion facing a corresponding first surface of the second strip portion; and splicing means for splicing said two strip portions with said two first surfaces contacting each other; characterized in that said splicing means comprise a pair of supports, each defining a support for a respective adhesive element; and activating means for moving the supports to and from an operating position wherein the supports contact each other and grip said two strip portions so that a first portion of the respective adhesive element contacts a respective said strip portion, and at least one second portion of the respective adhesive element contacts a corresponding second portion of the other adhesive element.

BRIEF DESCRIPTION OF THE DRAWINGS

A non-limiting embodiment of the present invention will be described by way of example with reference to the accompanying drawings, in which.

DETAILED DESCRIPTION OF TEE INVENTION

Figure 1:
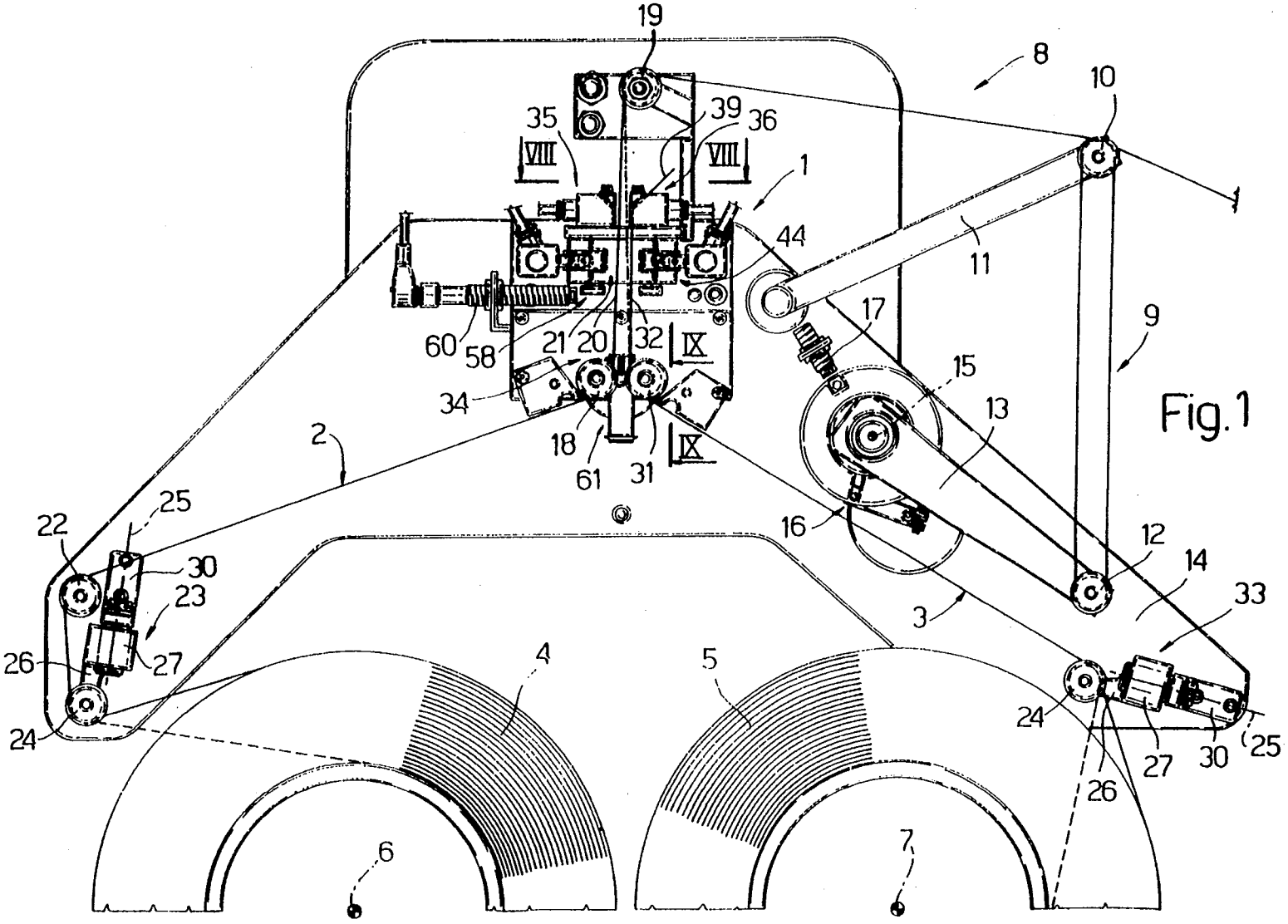
FIG. 1 shows a side view of a preferred embodiment of the device according to the present invention.

Number 1 in FIG. 1 indicates a device for splicing two narrow strips 2 and 3 wound off respective reels 4 and 5 rotating about respective axes 6 and 7 parallel to each other and perpendicular to the FIG. 1 plane. Device 1 forms part of a unit 8 for continuously feeding strip 2 to a user machine (not shown), and which, in addition to device 1, also comprises a known variable-capacity store 9 through which is fed a portion of varying length of strip 2. More specifically, store 9 comprises a number of first coaxial, adjacent pulleys 10 (only one shown) supported for rotation on a fixed arm 11; and a number of second coaxial, adjacent pulleys 12 (only one shown) connected for rotation to a first end portion of a further arm 13, a second end portion of which is hinged to a fixed plate 14 to enable arm 13 to rotate about an axis 15 parallel to axes 6 and 7. Arm 13 is rotated by a known crank mechanism 16 under control of a sensor 17, so as to move pulleys 12, in relation to pulleys 10, to and from a maximum-distance position (shown in FIG. 1) for varying the capacity of store 9.

Figure 7:
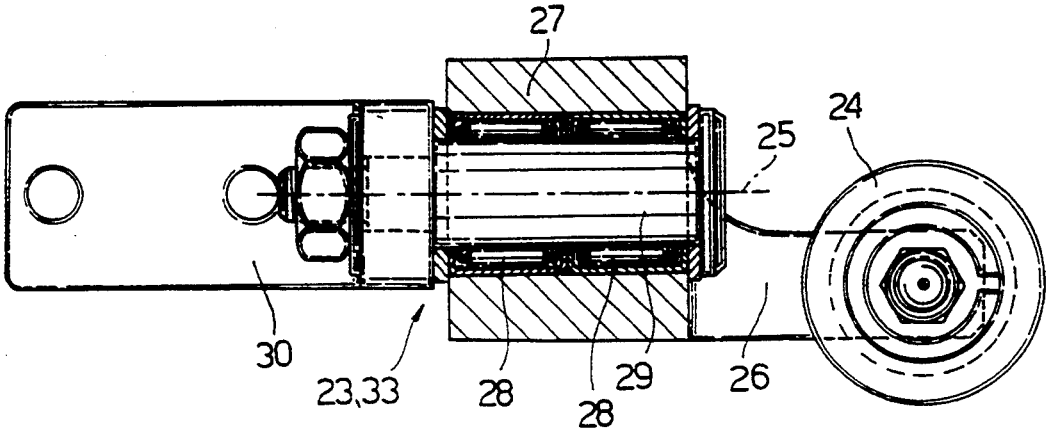
FIG. 7 shows a larger-scale partial section of a detail in FIG. 1.
Figure 8:
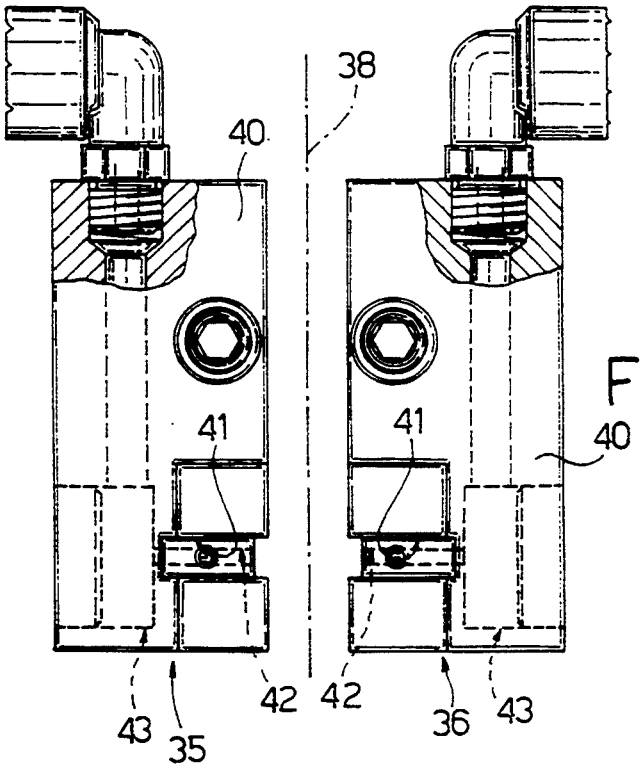
FIG. 8 shows a section along line VIII—VIII in FIG. 1.
Figure 9:
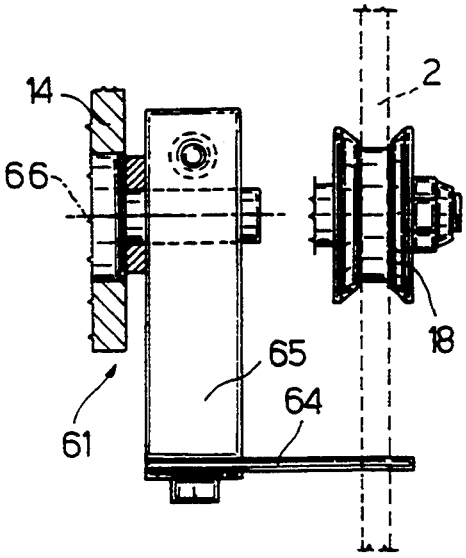
FIG. 9 shows a section along line IX—IX in FIG. 1.

Device 1 comprises two guide rollers 18 and 19 for guiding a portion 20 of strip 2 through a splicing station 21, and mounted in idle manner on respective fixed pins upstream from station 21 and store 9 respectively in the traveling direction of strip 2. Device 1 also comprises a further guide roller 22 mounted in idle manner on a respective pin integral with plate 14, and located between roller 18 and reel 4, and downstream, in the traveling direction of strip 2, from an input unit 23 having a roller 24 rocking about an axis 25 perpendicular to axes 6 and 7. More specifically, as shown in FIG. 7, roller 24 is connected for rotation to an end portion of a respective supporting arm 26, the opposite end portion of which is connected integral with a sleeve 27 connected, in rotary and axially-fixed manner by means of a pair of bearings 28, to a pin 29 coaxial with axis 25 and connected integral with plate 14 by means of a bracket 30.

To the side of roller 18, device 1 comprises a further guide roller 31 mounted in idle manner on a respective fixed pin parallel to the supporting pin of roller 18, for guiding an end portion 32 of strip 3 into station 21. Roller 31 is located downstream, in the traveling direction of strip 3, from a respective input unit 33 relative to strip 3, identical to unit 23, and indicated using the same numbering system.

Figure 3:
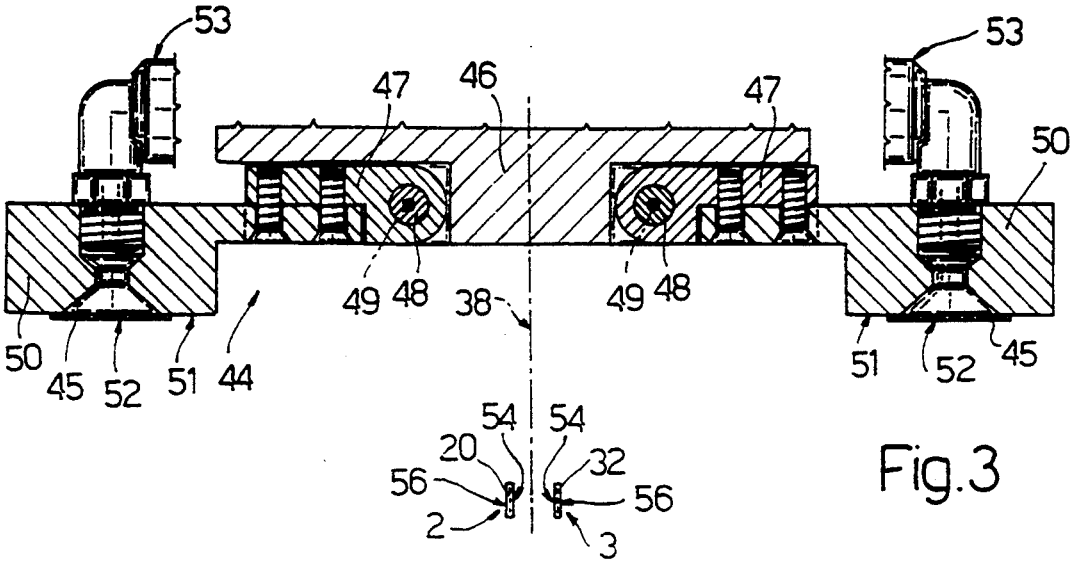
FIG. 3 shows a section along line III—III in FIG. 2.
Figure 4:
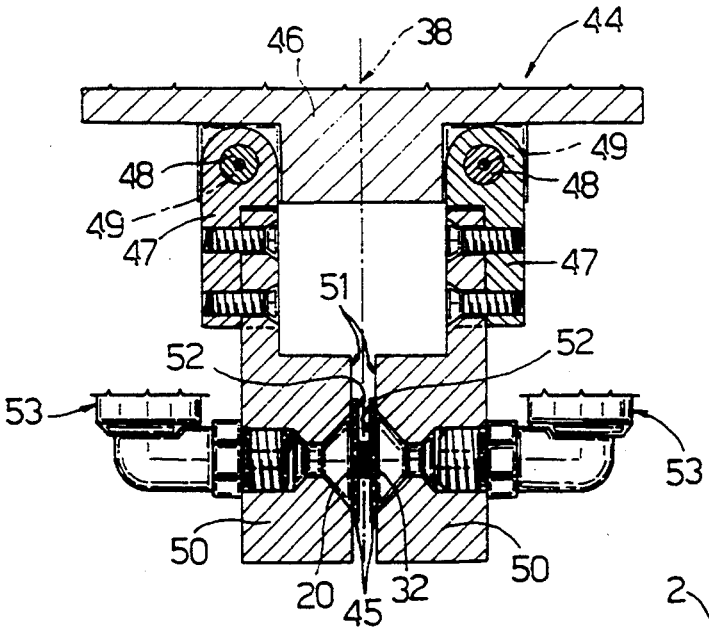
FIG. 4 shows the same view as in FIG. 3, with the FIG. 3 detail in a different operating position.
Figure 5:
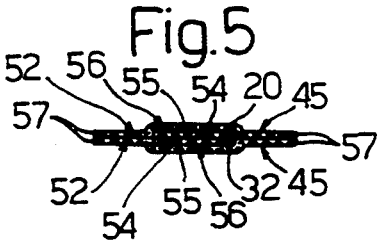
FIG. 5 shows a larger-scale view of a detail in FIG. 4.
Figure 6:
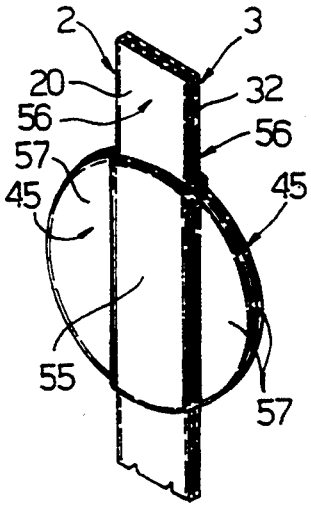
FIG. 6 shows an enlarged view in perspective of the FIG. 5 detail.

Rollers 18, 19 and 31 form part of a device 34 for guiding portions 20 and 32 through station 21, and also comprising two identical opposed stop units 35 and 36 supported on a common plate 37 integral with and perpendicular to plate 14, and which extend on either side of portions 20 and 32, and on either side of a longitudinal plane 38 (FIGS. 3 and 4) perpendicular to plates 14 and 37. In the example shown, unit 36 retains end 39 of portion 32; and each unit 35, 36 comprises a substantially parallelepiped body 40 connected integral with the surface of plate 37 facing roller 19, and presenting, on the side facing roller 19, an inclined suction channel 41 in which terminate the conduits 42 of a suction device 43.

Station 21 also presents a splicing unit 44 for splicing portions 20 and 32 by means of a pair of round adhesive labels 45, the diameter of which is greater than the width of portions 20 and 32. Unit 44 comprises a supporting body 46 connected integral with plate 14 on the opposite side of plate 37 to units 35 and 36. Unit 44 also comprises two arms 47 extending on either side of body 46 and plane 38, and presenting respective end portions hinged to body 46 by respective powered pins 48, so as to rotate about respective axes 49 parallel to each other and to plane 38, and perpendicular to axes 6 and 7. On the end portion opposite that connected to body 46, each arm 47 is fitted integral with a block 50 defined by a respective flat surface 51 defining a support for a respective adhesive label 45 retained contacting respective surface 51, with a respective adhesive surface 52 facing outwards, by means of a suction device 53.

Arms 47 rotate about respective axes 49 to move respective blocks 50 between an idle position (FIG. 3) wherein surfaces 51 extend coplanar with each other and perpendicular to plane 38, and a closed operating position (FIG. 4) wherein surfaces 51 are positioned parallel to each other and to plane 38, and substantially contacting each other. More specifically, in the operating position, blocks 50 grip portions 20 and 32 with respective surfaces 54 facing and contacting each other and placed one on top of the other. Also, each surface 51 supports respective label 45 so that it presents an intermediate portion 55 contacting the outer surface 56 of respective portion 20, 32; and lateral portions 57 projecting on either side of intermediate portion 55, beyond respective portion 20, 32, and adhering to the lateral portions 57 of the other label 45.

The position of arms 47 of unit 44 is controlled by a control system (not shown) which cooperates with a detecting unit 58 comprising an elongated element 59 fitted to one of pins 48 and eccentric in relation to respective axis 49; and a sensor 60 for detecting the angular position of element 59 and hence respective arm 47.

Figure 2:
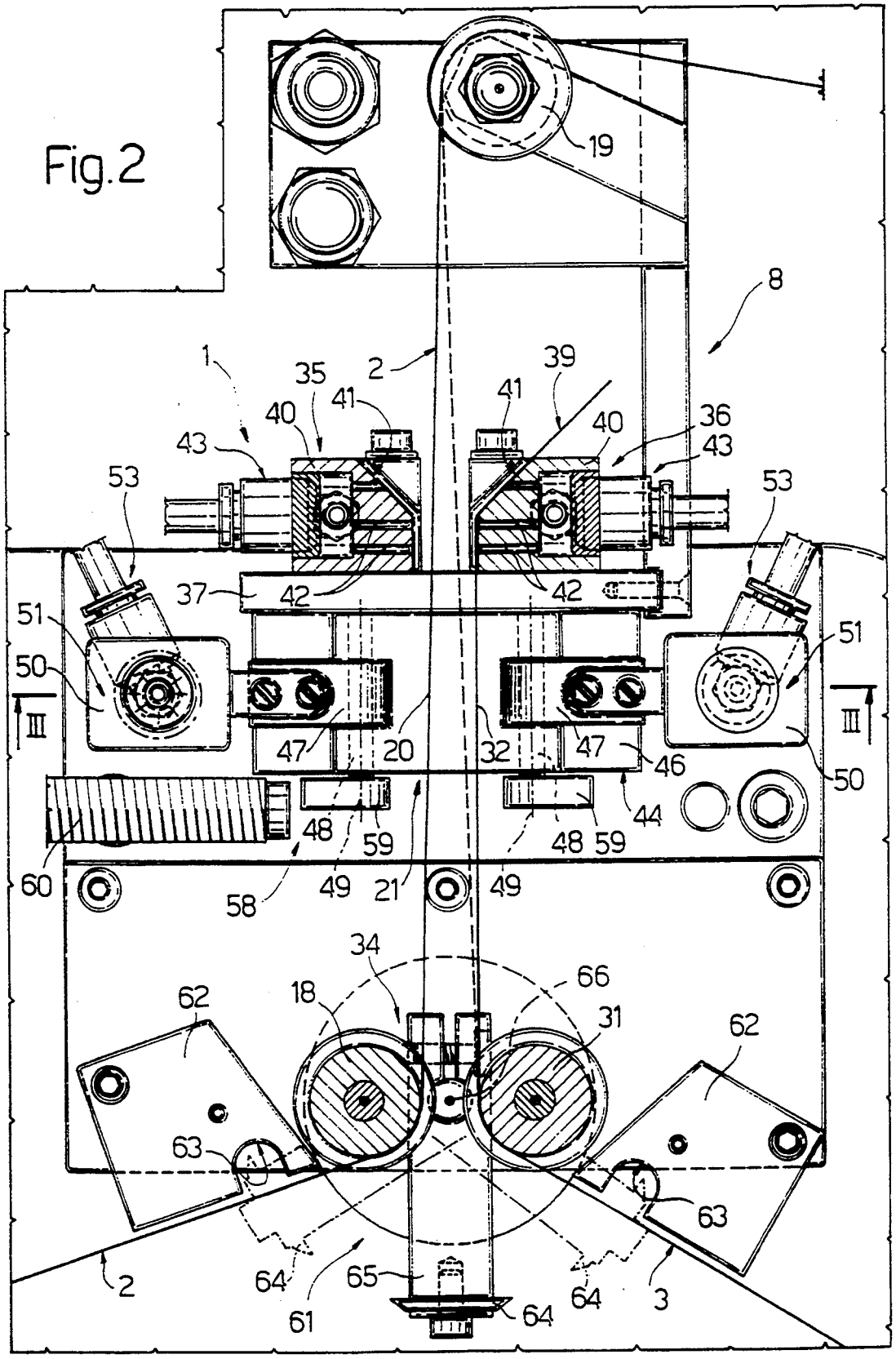
FIG. 2 shows a larger-scale view of a central portion of the FIG. 1 device.

Again with reference to FIG. 1 and, in particular, FIG. 2, device 1 comprises a cutting unit 61 located upstream from station 21 in the traveling direction of strip 2, and comprising two anvils 62 on either side of rollers 18 and 31 and each presenting a cavity 63 on the side facing the relative strip. Unit 61 also comprises a blade 64 perpendicular, when idle, to plane 38 and presenting two opposed cutting edges. Blade 64 is connected integral with one end of a pendulum 65 powered to swing about an axis 66 parallel to axes 6 and 7, and move blade 64 from said idle position (shown by the continuous line in FIG. 2) to either one of two limit operating positions (shown by the dotted line in FIG. 2) in each of which one of the cutting edges extends inside a respective cavity 63.

Operation of unit 8 as a whole, and of device 1 in particular, will now be described as of the condition shown in FIG. 1, wherein strip 2 is wound about rollers 18, 19, 22, 24, and is drawn along by the user machine (not shown); portion 32 of strip 3 is wound about roller 31, extends through station 21, and presents end 39 retained by suction inside channel 41 of respective stop device 36; blocks 50 are maintained by respective arms 47 in the idle position (FIG. 3), each supporting a respective label 45 with its adhesive surface 52 facing outwards; and blade 64 is maintained by pendulum 65 in the idle position.

As of the above condition, upon a known sensor (not shown) detecting that reel 4 is about to run out, arms 47 are rotated in opposite directions about respective axes 49 by pins 48, and blocks 50 are moved into the closed position to bring surfaces 54 of portions 20 and 32 into contact with each other, connect intermediate portion 55 of each label 45 to a respective surface 56, connect lateral portions 57 of each label 45 to the lateral portions of the other label, and so splice strips 2 and 3. During this operation, which involves arresting portion 20 inside station 21, the length of strip 2 required for continuing the operating cycle of the user machine (not shown) is absorbed by store 9.

At this point, pendulum 65 is activated and, rotating clockwise in FIG. 2, swings blade 64 towards strip 2 so as to cut it transversely; and stop unit 36 and unit 44 are deactivated so that arms 47 return to the idle position. At this point, strip 3, now released and connected integral with the trailing end of strip 2, is drawn along by the user machine (not shown); while the empty reel 4 is removed and replaced with a new reel (not shown), the strip (not shown) of which is wound about rollers 18, 22, 24, fed through station 21, and fixed inside channel 41 of respective unit 35.

What is claimed is:

1. A method of splicing two narrow strips (2, 3), the method comprising stages consisting in superimposing two portions (20, 32) of the two strips (2, 3); and splicing the two superimposed strip portions (20, 32); characterized in that the two superimposed strip portions (20, 32) are spliced by means of a pair of adhesive elements (45) placed on either side of the superimposed strip portions (20, 32), and each presenting a first portion (55) which is connected to a respective said strip portion (20, 32), and at least one second portion (57) projecting from the respective said strip portion (20, 32) and which is connected to the other adhesive element (45).

2. A method as claimed in claim 1, characterized in that said first portion (55) is an intermediate portion of the adhesive element (45); said second portion (57) comprising two lateral portions (57) extending on either side of the respective intermediate portion (55), and each of which is connected directly to a corresponding lateral portion (57) of the other adhesive element (45).

3. A method as claimed in claim 2, characterized in that said adhesive elements (45) are circular and larger in diameter than the width of said strip portions (20, 32).

4. A method as claimed in claim 1, characterized in that said second portions (57) are connected by gripping each said second portion (57) against the corresponding other second portion (57).

5. A method as claimed in claim 1, characterized in that said strip portions (20, 32) are superimposed, said first portions (55) connected to the respective strip portions (20, 32), and said second portions (57) connected to one another, by bringing both said adhesive elements (45) together on either side of said strip portions (20, 32).

* * * * *